United States Patent [19]

Brinkhof et al.

[11] Patent Number: 4,485,771

[45] Date of Patent: Dec. 4, 1984

[54] ENGINE BLOCK HEATER HAVING FLEXIBLE CLAMPING MEMBER

[75] Inventors: Joseph B. Brinkhof, Oshawa; Yih-Yi Chang, Willowdale, both of Canada

[73] Assignee: Budd Canada Inc., Kitchener, Canada

[21] Appl. No.: 442,007

[22] Filed: Nov. 16, 1982

[30] Foreign Application Priority Data

Mar. 5, 1982 [CA] Canada ..... 397747

[51] Int. Cl.[3] ..... F02N 17/06; H05B 3/02

[52] U.S. Cl. ..... 123/142.5 E; 219/208; 219/318; 219/336; 219/536

[58] Field of Search ..... 123/142.5 R, 142.5 E; 219/205, 208, 318, 335, 336, 536

[56] References Cited

U.S. PATENT DOCUMENTS

| | | | |
|---|---|---|---|
| 3,587,548 | 6/1971 | Wernicke | 123/142.5 E |
| 3,646,314 | 2/1972 | Windsor | 123/142.5 E |
| 3,766,356 | 10/1973 | Feldmann | 219/208 |
| 3,979,574 | 9/1976 | Rynard | 123/142.5 E |
| 4,175,229 | 11/1979 | Brinkhof et al. | 219/208 |
| 4,242,564 | 12/1980 | Kendall | 123/142.5 E |
| 4,286,139 | 8/1981 | Taylor | 123/142.5 E |

*Primary Examiner*—Ira S. Lazarus
*Attorney, Agent, or Firm*—Stanley G. Ade

[57] ABSTRACT

An engine block heater adapted for insertion through an opening in the block wall of an internal combustion engine has a novel arrangement for securing the heater within the opening of the block wall. The heater includes a plug member having a heating element, an adjustable screw and a fastening assembly attached to the screw and extending from one side of the heater into the interior of the engine block. The adjustable screw loosely passes through the plug member for adjusting the position of the fastening assembly. The fastening assembly comprises an elongated flexible bar and a rigid member. The flexible bar has the ends thereof normally biased such that one surface of the bar is flat and the distance between the ends is greater than the diameter of the block aperture. The flexible bar is capable of bending in opposing directions to reduce the distance between its ends and facilitate the insertion of the flexible bar through the block aperture. The rigid member is securable in at least partial contacting and supporting relation with one side of the flexible member to prevent the bending of the flexible member in one of the opposing directions. When the adjustable screw means is manipulated to draw the flexible member toward one side of the plug member, the rigid member prevents the flexible assembly from bending and results in the ends of the flexible member moving into engaging relation with interior wall portions of the block. This novel arrangement allows for repeated insertion and removal of the heater from the engine block.

8 Claims, 3 Drawing Figures

ENGINE BLOCK HEATER HAVING FLEXIBLE CLAMPING MEMBER

BACKGROUND OF THE INVENTION

The present invention relates to improvements in engine block heaters for internal combustion engines. In particular, it relates to the improvements and method of retaining the heaters in the core hole of an automotive engine block.

In the construction of internal combustion engines adapted to be water-cooled, it is common practice to cast the cylinder block and water jacket in one piece using sand molding. Apertures are provided for the removal of sand following the casting operation; when the engines are finally assembled, the apertures may be sealed with suitable dished plates.

Commonly, these apertures may be used for fitting electrical heating means into the engine. Some prior art engine block heaters finding particular application in automobile engines are disclosed in Canadian Pat. No. 842,973 issued May 26, 1970 to L. E. Windsor and Canadian Pat. No. 850,767 issued Sept. 1, 1970 to C. A. Ehgoetz. In the engine block heaters disclosed in these patents, a straight yoke or clamping assembly is employed to fasten the plug member of the block heater in sealed relation within the block aperture. A screw passes either loosely through the plug member of the heater or through the elongated straight yoke. As a result, either the screw or the yoke may be canted to facilitate the insertion of the yoke through the block aperture. Once inserted, the screw is manipulated to draw the yoke back towards one face of the plug member, bringing the ends of the yoke member into engaging relation with interior wall portions of the engine block to rigidly secure the heater within the block aperture.

While engine block heaters as described hereinabove are still in use, these heaters are not well suited for use in automobile engines having special limitations in the size of the engine block. A number of heaters have been developed for use in automobile engine blocks having special limitations, and are disclosed in U.S. Pat. No. 3,766,356 issued Oct. 16, 1973 to Feldmann; U.S. Pat. No. 4,175,229 issued Nov. 20, 1979 to Brinkhof et al; and Canadian patent application No. 336,783 filed Sept. 28, 1979 in the name of Brinkhof et al. Each of the engine block heaters described in these references has a yoke or clamping assembly normally having an outside diameter less than the diameter of the aperture provided in the engine block so as to facilitate insertion of the yoke assembly through the aperture into the engine block. A screw and a pressure bar are provided for deforming the yoke assembly. The screw is attached to the pressure bar which may be drawn toward one surface of the plug member of the heater to deform the yoke assembly. Once deformed, the yoke assembly has an outside diameter that is larger than the diameter of the aperture in the block wall of the engine block. The pressure bar holds the deformed yoke assembly against the block wall so as to maintain the heater in secured relation with the engine block. The removal of this type of heater involves loosening the screw, moving the pressure bar and yoke assembly away from the plug member, and subsequently pulling the heater out of the engine block causing the yoke assembly to deform a second time into a diameter less than that of the aperture of block. Deformation of the yoke assembly occurring during repeated insertion and removal of the engine block heater stresses the material of the yoke assembly. In practice, the yoke assembly allows for insertion and removal of the heater a limited number of times.

Engine block heaters which can be inserted and removed from an engine block a repeated number of times are disclosed in Canadian Pat. No. 854,325 issued Oct. 20, 1970 to L. E. Windsor, and Canadian patent application Ser. No. 389,875 filed Nov. 12, 1981 in the name of Y. Y. Chang et al. These block heaters rely on pivotal movement of the wing portions of the yoke or clamping assembly to change the outside diameter of the yoke assembly from a diameter that facilitates the insertion of the yoke assembly into the engine block to a diameter that allows the ends of the yoke assembly to be brought into engaging relation with interior wall portions of the block. These block heaters do not provide the simplicity provided by some of the block heaters having deformable yoke assemblies.

Another form of engine block heater disclosed in Canadian Pat. No. 870,788 issued May 11, 1971 to W. H. Wernicke, has a spring material normally biased in a bow. A screw passes through the plug member and the spring material. When the screw is manipulated to draw the spring material back toward the plug member, the edges of the bow material bite into the side of the aperture. The problem associated with this block heater is that the strength of the spring material must be considerable to bite into the wall of the aperture and secure the plug member in the aperture. Further, while the spring means may be repeatedly used, the spring means is not operable in the event that the ends of the spring means are brought into engaging relation with interior wall portions of the block.

It is therefore an object of the present invention to provide a fastening assembly for an engine block heater that is relatively inexpensive and permits the engine block heater to be repeatedly inserted into and removed from the engine block.

Briefly, the present invention provides a heater suitable for use in an aperture of a block of an internal combustion engine. The heater comprises a plug member having a heating element extending from one side of the plug member. The plug member is adapted for insertion into the block aperture in sealing relation therewith such that the heating element is positioned in the block. A clamping means is provided for securing the plug member in the aperture. The heater also provides an adjustable means passing at least loosely through one of the plug member and clamping means for adjusting the position of the clamping means relative to the plug member. The clamping means includes an elongated flexible member having its ends normally biased such that the distance between the ends is greater than the diameter of the aperture. The flexible member is capable of bending in opposing directions to reduce the distance between its ends and facilitate insertion of the flexible member through the aperture. The clamping means also includes a rigid member securable in at least partial contacting and supporting relation with one side of the flexible member to prevent bending of the flexible member in one of said opposing directions. Thus, when the adjusting means is manipulated to draw the flexible member toward the plug member, the ends of the flexible member move into engaging relation with the interior wall portions of the block because the rigid member prevents the bending of the flexible member.

Further, the heater may be readily removed from the engine block by backing off the adjusting means and canting either the adjusting means or the clamping means depending on which one of the plug member or clamping means the adjusting means passes loosely through. It should be understood that should the adjusting means pass loosely through the plug member, a sealing O ring surrounding the adjusting means and the aperture of the plug member is provided to ensure a proper seal.

Additionally, in the preferred construction, the adjusting means comprises a screw which passes loosely through the plug member. In alternate constructions at least one of the flexible member and the rigid member is threadably secured with the screw. Preferably, both the flexible and rigid members are threadably secured with the screw.

For a better understanding of the nature and objects of the present invention, reference may be had by way of example to the accompanying diagrammatic drawings of the preferred embodiment of the present invention in which.

Figure 1:
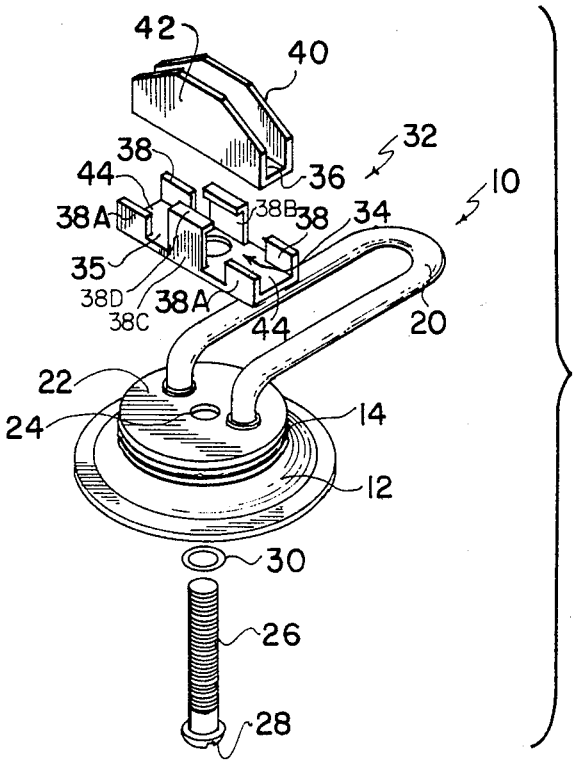
FIG. 1 is a perspective exploded view of the heater of the present invention.
Figure 2:
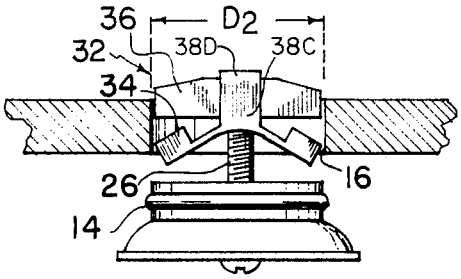
FIG. 2 is a side sectional view of the heater showing the heater being inserted into the engine block; and, FIG. 3 is a side sectional view showing the heater of the present invention with the fastening means secured in the heater within the engine block.
Figure 3:
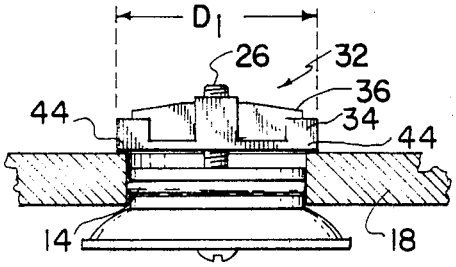

Referring to FIGS. 1 to 3, the engine block heater of the preferred embodiment is shown generally at 10. Heater 10 comprises a plug member 12 having an O ring 14 located in a groove on a peripheral surface of the plug member 12 to provide a fluid tight seal between the plug member 12 and the aperture 16 of the engine block 18. A cranked metal sheathed heating element 20 extends from one side 22 of plug member 12. Plug member 12 has a central opening 24 through which passes an adjusting means illustrated by screw element 26. The screw 26 has its head 28 accessible from the outside of the block 18 and has its shank loosely extending through aperture 24 of plug 12. An O ring 30 provides a fluid tight seal between the plug member 12 and the screw element 26.

The clamping means is generally shown at 32. The clamping means 32 includes an elongated, flexible member or bar 34 and a rigid member 36. As illustrated, the flexible bar 34 and the rigid member 36 have a U-shape when viewed in cross section. Flexible bar 34 is provided with upstanding cheek portions 38, 38B and opposing upstanding cheek portions 38A, 38C. The rigid member 36 is also provided with upstanding cheek portions 40 and 42. The upstanding cheek portions 38 and 38A of flexible bar 34 are adapted to receive the rigid member 36 in polar alignment therewith. Two of the cheek portions of the bar 34 arranged centrally and indicated at 38B, 38C are provided with inturned lips 38D, at the upper edges thereof that overlap cheeks 40, 42 of rigid member 36 so as to attach the rigid member 36 and flexible member 34 in secured relation.

The flexible bar 34 is normally biased such that it has an elongated flat surface 35 and its ends 44 have a distance D1 which is greater than the diameter (D2) of the aperture 16 of block 18. The flexible member 34 is bendable in a direction shown in FIG. 2 to facilitate the insertion of the clamping means 32 into the block of the engine. The rigid member 36 is positioned as illustrated in FIG. 3 in at least partial contacting and supporting relation with one side of flexible bar 34 so as to prevent the flexible bar 34 from bending in a direction opposite to the direction it bends in FIG. 2. Thus, flexible bar 34 has its ends held in engaging relation with interior wall portions of block 18 by the rigid member 36 (see FIG. 3).

It should be understood that the removal of the block heater from the engine block is permitted by backing-off screw 26, removing the plug from the aperture 16, and canting screw 26 such that the flexible member 34 passes at an angle which is not at right angles to the central axis of the aperture 16. This is similar to the manner the yoke assembly of aforementioned Canadian Pat. No. 850,767 is removed.

The foregoing has been a description of the preferred embodiment of the present invention and it should be understood that alternate embodiments may be readily apparent to a man skilled in the art in view thereof. Accordingly, the present invention should only be limited to that which is claimed in the accompanying claims.

We claim:

1. A heater suitable for use in an aperture of a block of an internal combustion engine, said heater comprising: a plug member having a heating element extending from one side thereof, said plug member being adapted for insertion into said aperture in sealing relation therewith such that said heating element is positioned in said block; a clamping means for securing said plug member in said aperture; and, an adjustable means passing loosely through at least one of the plug member and clamping means for adjusting the position of the clamping means relative to the plug member; and, said clamping means comprising an elongated flexible member, having ends thereof normally biased such that the distance between said ends is greater than the diameter of said aperture, said flexible member being capable of bending in opposing directions to reduce the distance between its ends and facilitate insertion of said flexible member through said aperture, a rigid member for contacting and supporting one side of said flexible member to prevent bending of said flexible member toward said side in one of said opposing directions when said adjusting means is manipulated to draw said flexible member toward said plug member whereby the ends of the flexible member are moved into engaging relation with interior wall portions of said block, and means for attaching the rigid member to said flexible member to allow bending in the other of said directions whereby the flexible member and rigid member can pass through the aperture in attached relation with the flexible member bending away from said rigid member.

2. The heater of claim 1 wherein said adjusting means is threadably secured with at least one of said flexible member and said rigid member.

3. The heater of claim 1 wherein said flexible member comprises an elongated bar biased such that one elongated surface thereof is normally flat.

4. The heater of claim 3 wherein said one elongated surface includes said ends movable into engaging relation with the interior wall portions of the block.

5. The heater of claim 1 wherein said flexible member includes opposing upstanding cheek portions for receiving in polar alignment therewith said rigid member.

6. The heater of claim 5 wherein said rigid member and said flexible member each have a U-shaped cross section.

7. The heater of claim 1 wherein said attaching means comprises cooperating means on said flexible member and said rigid member.

8. The heater of claim 7 wherein said attaching means comprises a pair of central opposing upstanding cheek portions on said flexible member including inturned lips which overlap said rigid member to mutually secure the members.

* * * * *